US009797685B2

(12) United States Patent
Finley

(10) Patent No.: US 9,797,685 B2
(45) Date of Patent: Oct. 24, 2017

(54) ARCHERY SIGHTING DEVICE FOR A MECHANICAL RELEASE

(71) Applicant: John Franklin Finley, Malvern, AR (US)

(72) Inventor: John Franklin Finley, Malvern, AR (US)

( * ) Notice: Subject to any disclaimer, the term of this patent is extended or adjusted under 35 U.S.C. 154(b) by 130 days.

(21) Appl. No.: 14/967,088

(22) Filed: Dec. 11, 2015

(65) Prior Publication Data

US 2016/0169623 A1 Jun. 16, 2016

Related U.S. Application Data

(60) Provisional application No. 62/090,700, filed on Dec. 11, 2014.

(51) Int. Cl.
*F41G 1/467* (2006.01)
*F41B 5/14* (2006.01)

(52) U.S. Cl.
CPC ..... *F41G 1/467* (2013.01); *F41B 5/1469* (2013.01)

(58) Field of Classification Search
CPC . F41G 1/467; F41G 1/35; F41G 1/345; F41G 1/54; F41G 1/18; F41G 1/473; F41G 3/323; F41B 5/1426; F41B 5/14; F41B 5/1469
USPC ..... 33/265; 124/87
See application file for complete search history.

(56) References Cited

U.S. PATENT DOCUMENTS

| | | | | |
|---|---|---|---|---|
| 7,900,365 | B1 * | 3/2011 | Johnson | F41G 1/467 33/265 |
| 9,141,215 | B2 * | 9/2015 | Donahoe | F41B 5/1403 |
| 9,429,392 | B1 * | 8/2016 | Ledbetter | F41G 1/467 |
| 2002/0148125 | A1 * | 10/2002 | Shepherd | F41G 1/467 33/265 |
| 2014/0176463 | A1 * | 6/2014 | Donahoe | F41B 5/1403 345/173 |
| 2016/0169623 | A1 * | 6/2016 | Finley | F41B 5/1469 124/87 |
| 2016/0231086 | A1 * | 8/2016 | Pellett | F41G 1/467 |

* cited by examiner

*Primary Examiner* — Yaritza Guadalupe-McCall

(57) ABSTRACT

A sighting device for a bow which attaches to a release mechanism being used with said bow. The sighting device includes a sighting assembly, a positioning-and-orienting arm with multiple degrees of freedom, and a mounting clamp. The sighting assembly includes an annular plate, a sight eyepiece, and a telescoping support arm. The sight eyepiece is oriented normal to the annular plate and is positioned within a lateral boundary that is defined as an extension of an inner wall of the annular plate. The telescoping support arm is swivelably and adjacently connected to the annular plate and holds the sight eyepiece in place. A first end of the positioning-and-orienting arm is adjacently attached to the annular plate and a second of the positioning-and-orienting arm is attached to the mounting clamp. The mounting clamp is attached to the release mechanism, thus positioning the sighting assembly directly in front of the user's eye.

17 Claims, 7 Drawing Sheets

ARCHERY SIGHTING DEVICE FOR A MECHANICAL RELEASE

The current application claims a priority to the U.S. Provisional Patent application Ser. No. 62/090,700 filed on Dec. 11, 2014.

FIELD OF THE INVENTION

The present invention relates generally to accessories for archery. More specifically, the present invention is an archery sighting device which attaches to a mechanical release to create a truer and easier alignment, an increased and clearer field of view and allows the first point of aim or alignment to be placed directly in front of the eye.

BACKGROUND OF THE INVENTION

Archers typically require the assistance of sights to ensure accuracy and precision. There are two mains ways to integrate a sight into a bow, a string peep sight and an archery sight. Traditional string peep sights need to be attached to the bowstring itself. This adds weight and drag to the string, decreasing the speed of the arrow, and increasing the noise of the bow. The archery sight needs to be attached to the body of the bow. This adds weight to the bow and is not compatible with every bow design. The main shortcoming of both of these approaches is that there is a certain degree of inconsistency because the sight is positioned too far away from the user's face, thus yielding subpar assistance to the archer.

The present invention eliminates the shortcomings of modern archery sights by positioning the peep hole directly in front of the user's eye. This is accomplished by mounting the sight to a mechanical release, which resultantly places the sight right in front of the user's face. A mechanical release is a device which helps to pull, hold, and release a bowstring more precisely. The present invention includes an adjustable support frame, thus allowing the user to further customize the positioning of the sight, creating a more consistent point of aim and a better point of aim than that of an in string peep sight and a clearer and more open field of view. The archery sighting device allows a user to stabilize the archery sighting device unlike any other archery sight on the market via eye assembly which comprises a removable nose piece, a face ring, and an eye ring. The archery sighting device provides a user with as many customizations he or she may need to achieve the most accurate, precise, and consistent shooting style needed to shoot the target.

DETAIL DESCRIPTIONS OF THE INVENTION

All illustrations of the drawings are for the purpose of describing selected versions of the present invention and are not intended to limit the scope of the present invention.

The present invention generally relates to archery bow sights. More specifically, the present invention is a sighting device for a bowstring release mechanism, also known as a release aid. The present invention mounts to the bowstring release mechanism and includes an aiming sight, thus positioning the aiming sight directly in front of the user's face. Additionally, the present invention utilizes a multiple degree-of-freedom support arm in conjunction with an adjustable sight in order to allow users to position and adjust the sight to their exact needs and preferences. As a result, the present invention aids the user in improving his/her natural point of aim, thus improving his/her marksman skills in archery.

Figure 1:
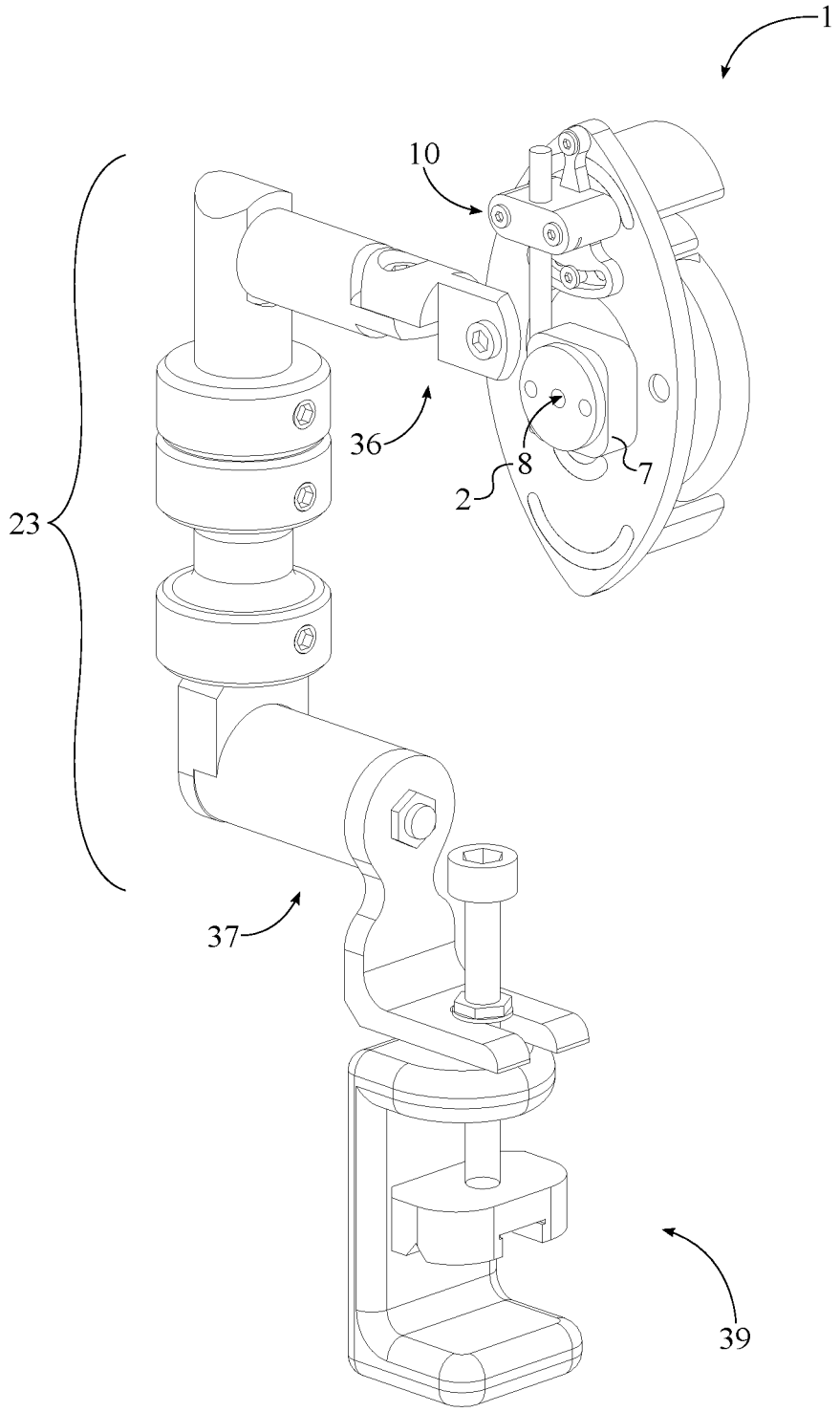
FIG. 1 is a perspective view of the present invention.
Figure 5:
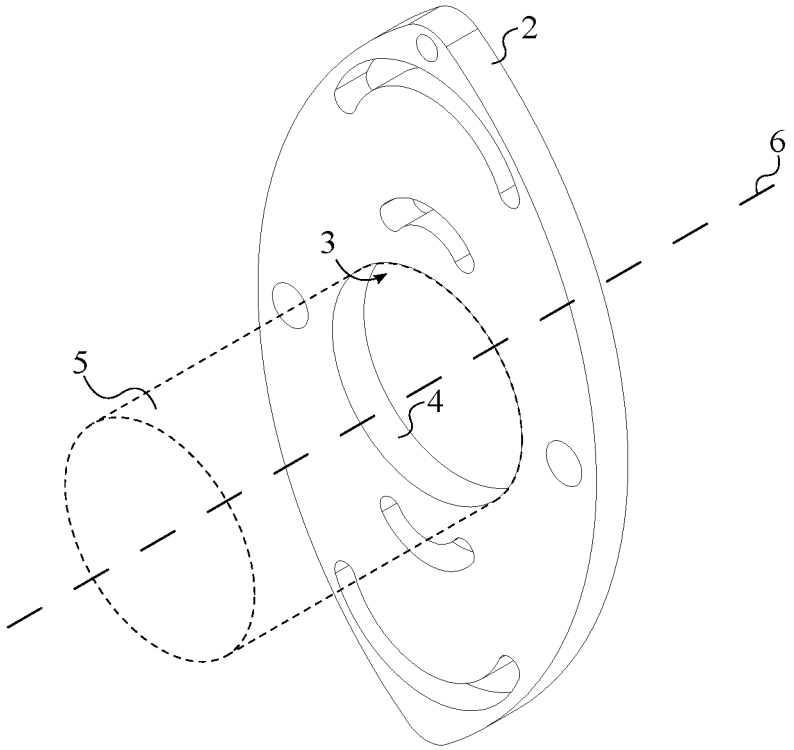
FIG. 5 is a perspective view of the annular plate component of the present invention.

Referring to FIG. 1, the present invention comprises a sighting assembly 1, a positioning-and-orienting arm with multiple degrees of freedom 23, and a mounting clamp 39. The sighting assembly 1 acts as a physical point of contact and a visual anchor for the user while he or she is aiming a bow. The physical point of contact ensures a consistent form is used from shot to shot, while the visual anchor aids the user in aligning the eye with the target, both of which are essential for accuracy and precision. The sighting assembly 1 comprises an annular plate 2, a sight eyepiece 7, and a telescoping support arm 10. The annular plate 2 supports the sight eyepiece 7 and provides the user with a preliminary visual anchor point, which is a central hole 3 of the annular plate 2. The central hole 3 is used to frame the target to a certain degree. The preferred shaped of the annular plate 2 is an oval to conform to the contours of the human face, although alternative shapes may be also used as well. A lateral boundary 5 is defined as an extension of an inner wall 4 of the annular plate 2 which is used to ensure proper placement of the sight eyepiece 7 as seen in FIG. 5. The sight eyepiece 7 provides the visual anchor for the user through a first peephole 8 of the sight eyepiece 7. The first peephole 8 of the sight eyepiece 7 provides the user with a visual reference, a visual anchor, in order to align his or her eye with the target. The sight eyepiece 7 is oriented normal to the annular plate 2 with the first peephole 8 of the sight eyepiece 7 being positioned parallel and within the lateral boundary 5. The sight eyepiece 7 is held in place by the telescoping support arm 10. The telescoping support arm 10 is swivelably and adjacently connected to the annular plate 2. The sight eyepiece 7 is adjacently connected to telescoping support arm 10, opposite to the annular plate 2. This configuration allows the sight eyepiece 7 to be positioned anywhere within the lateral boundary 5, resulting in a high degree of customization for the user.

Figure 2:
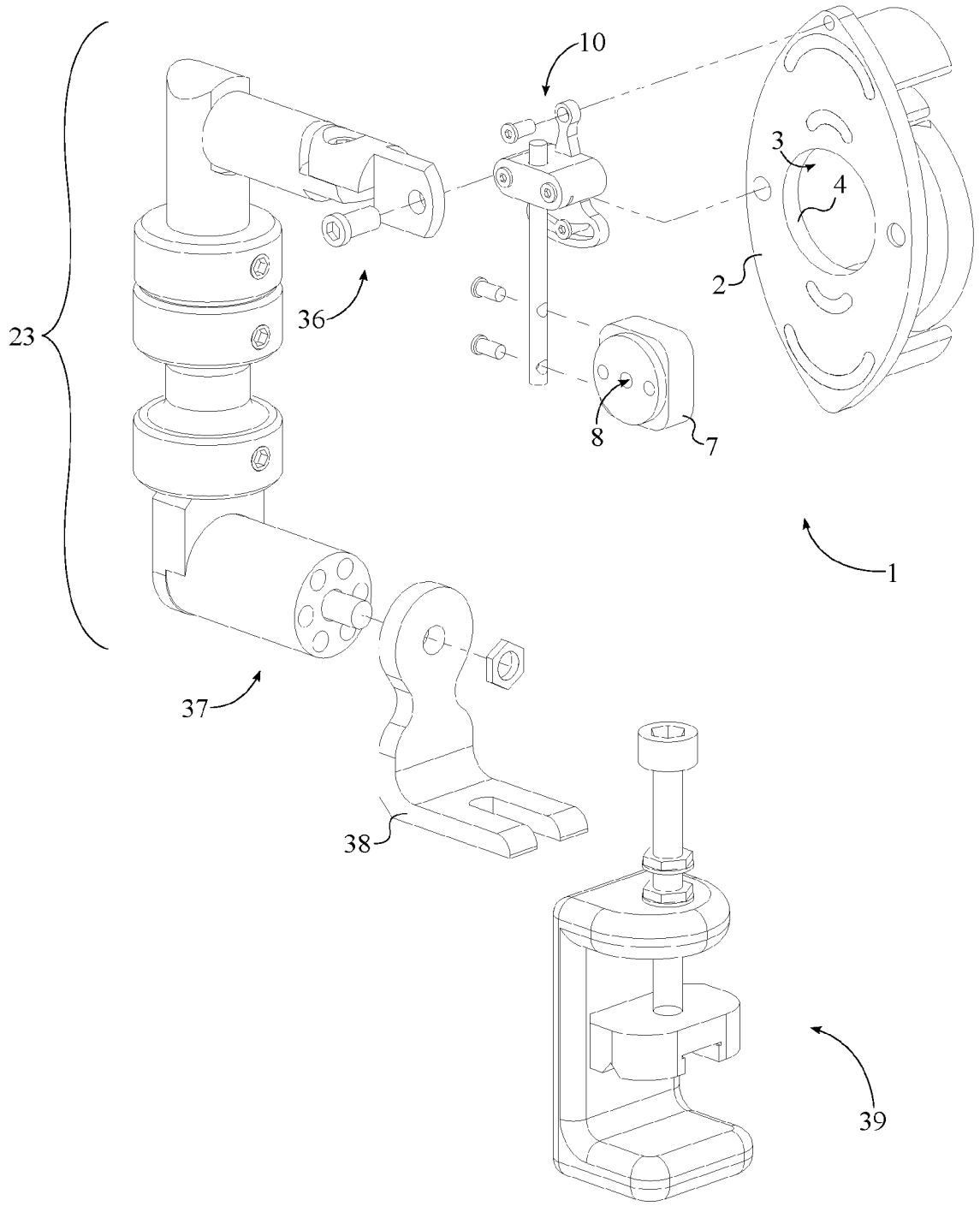
FIG. 2 is an exploded perspective view of the present invention.

The positioning-and-orienting arm 23 connects the mounting clamp 39 to the sighting assembly 1 as seen in FIG. 1 and FIG. 2. A first end 36 of the positioning-and-orienting arm 23 is adjacently attached to the annular plate 2, preferably laterally attached to the annular plate 2. A second end 37 of the positioning-and-orienting arm 23 is adjacently attached to the mounting clamp 39. For customization purposes the positioning-and-orienting arm 23 utilizes a multitude of pivot junctions, hinge connections, and telescoping mechanisms. This allows various portions of the positioning-and-orienting arm 23 to rotate, pivot, and extent in length, thus allowing the user to customize the position and configuration of the sighting assembly 1 relative to the mounting clamp 39. Two of the main configurations are a left-handed configuration and a right-handed configuration, yielding an ambidextrous device. The mounting clamp 39 mounts the present invention to the bowstring release mechanism, thus positioning the present invention directly in front of the user's face. A variety of mechanisms and designs may be used for the components of mounting clamp 39. The preferred design is a C-clamp that is sized and configured for the bowstring release mechanism.

Figure 4:
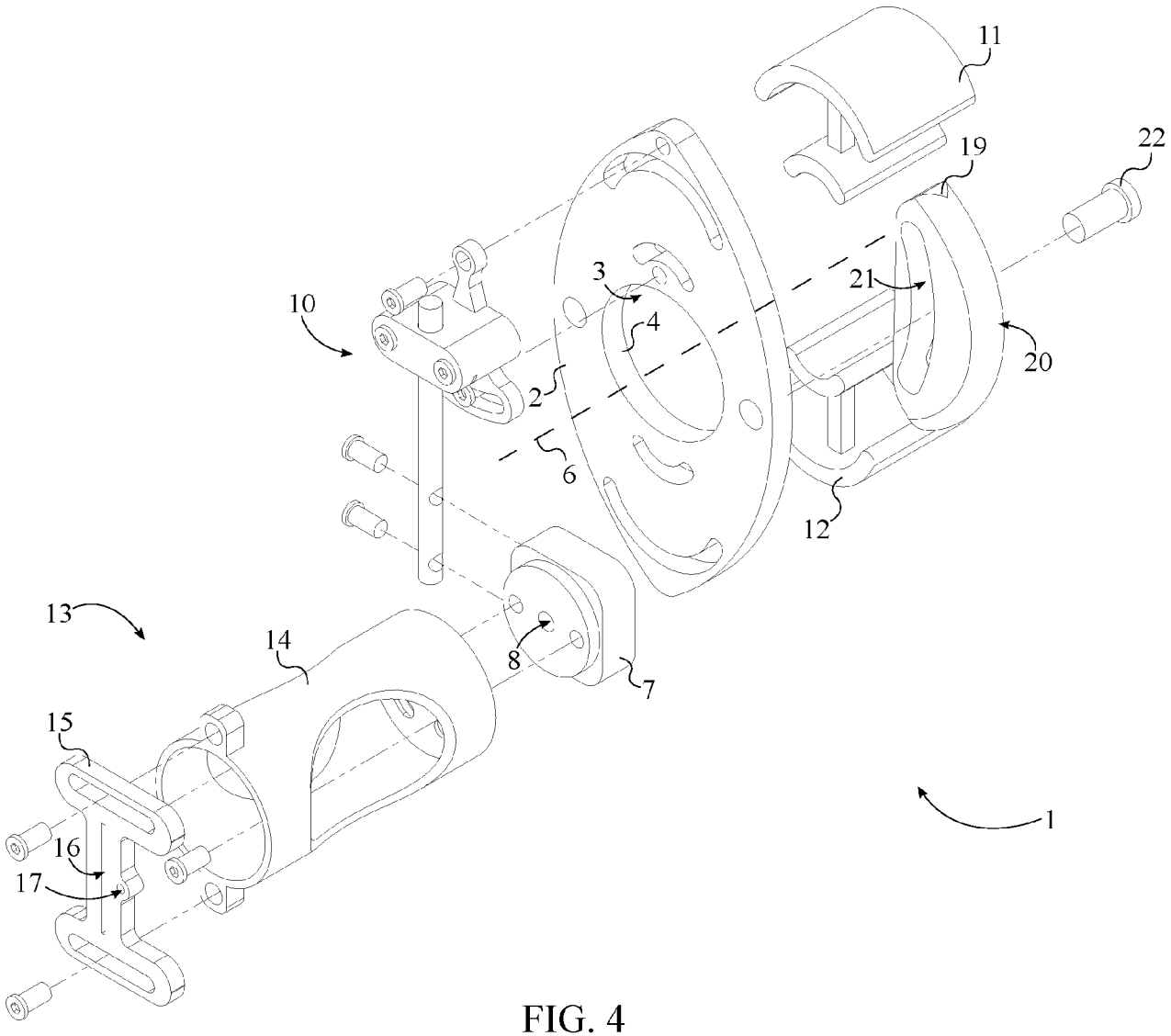
FIG. 4 is an exploded perspective view of the sighting assembly component of the present invention with the adjustable sighting gauge included.

Referring to FIG. 4, the sighting assembly 1 further comprises a first eye support 11, a second eye support 12, a nose support 19, and a stud 22. The first eye support 11, the second eye support 12, and the nose support 19 provide physical anchor points for the user in order to facilitate proper form during shooting. The first eye support 11 and the second eye support 12 are connected adjacent to the annular plate 2, opposite the sight eyepiece 7. Furthermore, the first eye support 11 and the second eye support 12 are positioned opposite to each other across the central hole 3 of the annular plate 2 as seen in FIG. 4. This configuration provides the user with reference points in order to properly position his or her eye in relation to the present invention. More specifically, the first eye support 11 is designed to be positioned above the eye of user, pressing against the eyebrow. The second eye support 12 is designed to be positioned below the eye of the user, pressing against the cheek. In the preferred embodiment of the present invention, the first eye support 11 and the second eye support 12 both comprise two semi-elliptical protrusions that are composed of a soft rubber material. The semi-elliptical protrusions are sized to compliment the contours of the human face, the region directly around the eye to be more specific. When used accordingly, the first eye support 11 and the second eye support 12 position the eye of the user directly in front of the central hole 3.

The nose support 19 provides a cushion for the user's nose and acts as an additional physical anchor. Referring to FIG. 4, the nose support 19 comprises a semi-elliptical concave surface 20 and an arc-shaped track 21. The semi-elliptical concave surface 20 is used to engage and compliment the natural contours of the nose, resulting in a comfortable fit. The arc-shaped track 21 traverses through the nose support 19, parallel to the semi-elliptical concave surface 20, and allows the nose support 19 to translate and rotate relative to the annular plate 2. More specifically, the stud 22 in conjunction with the arc-shaped track 21 allow the nose support 19 to translate and rotate. The stud 22 and the first end 36 of the positioning-and-orienting arm 23 are positioned opposite to each other about the central hole 3 of the annular plate 2. A shank of the stud 22 is sized to the width of the arc-shaped track 21 and a head of the stud 22 is sized greater than the width of the arc-shaped track 21 in order to allow the stud 22 to both press against the annular plate 2 and slide within the arc-shaped track 21 depending on its torque setting. The nose support 19 is slidably and rotatably connected to the annular plate 2 by engaging the stud 22 into the arc-shaped track 21. Unscrewing the stud 22 will release the nose support 19 and allow for rotation, translation, and therefore repositioning. Screwing the stud 22 in will press the head of the stud 22 against the nose support 19, locking the nose support 19 in its current configuration. It is preferred that the semi-elliptical concave surface 20 is positioned offset from a lateral surface of the annular plate 2 such that the nose of the user properly engages the nose support 19. Different shapes, designs, and fastening mechanisms may be used for the nose support 19 in alternative embodiments of the present invention.

Figure 6:
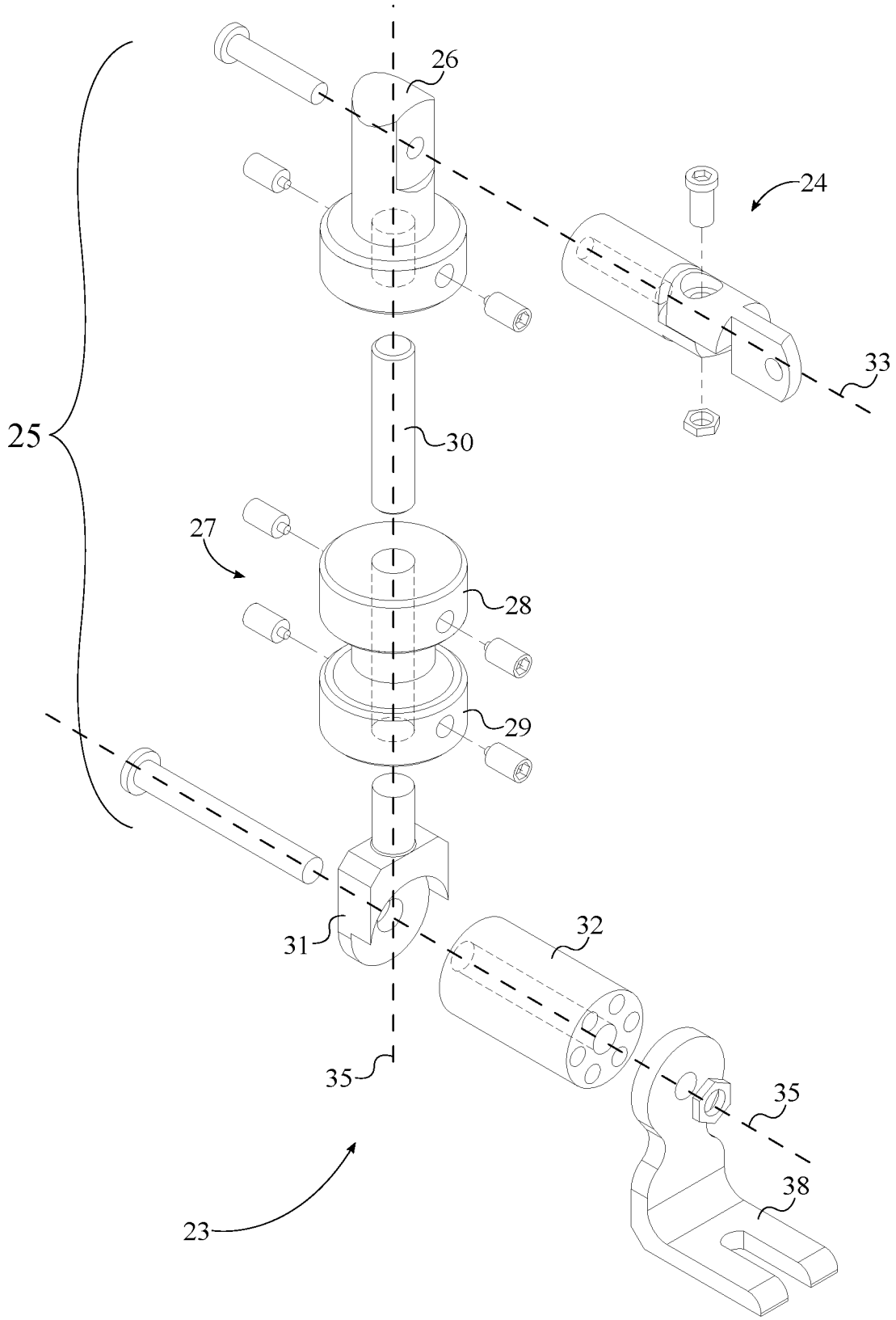
FIG. 6 is an exploded perspective view of the positioning-and-orienting arm and offsetting bracket components of the present invention.

The positioning-and-orienting arm 23 connects the mounting clamp 39 to the sighting assembly 1. The positioning-and-orienting arm 23 preferably comprises a lockable hinge joint 24, a telescoping link 25, and a tubular spacer 32 as seen in FIG. 6. In addition, the positioning-and-orienting arm 23 is also used in conjunction with an offsetting bracket 38. The lockable hinge joint 24 provides a means for adjusting the orientation of the sighting assembly 1 about its yaw axis. The lockable hinge joint 24 is rotatably and adjacently attached to the annular plate 2. The rotatable connection between the lockable hinge joint 24 and the annular plate 2 provides a means for adjusting the orientation of the sighting assembly 1 about its pitch axis. The telescoping link 25 provides a means for extending or shortening the distance between the mounting clamp 39 and the sighting assembly 1. Thus, the telescoping link 25 is adjacently positioned to the lockable hinge joint 24, opposite the annular plate 2, and is rotatably connected to the lockable hinge joint 24. The rotatable connection between the telescoping link 25 and the lockable hinge joint 24 also provides a means for adjusting the orientation of the sighting assembly 1 about its roll axis. The tubular spacer 32 is perpendicularly oriented to the telescoping link 25 and is adjacently positioned to the telescoping link 25, opposite the lockable hinge joint 24. Additionally, the tubular spacer 32 is rotatably connected to the telescoping link 25 in order to provide an additional degree of freedom for the positioning-and-orienting arm 23. The mounting clamp 39 is adjacently connected to the tubular spacer 32 by the offsetting bracket 38, opposite the telescoping link 25. The offsetting bracket 38 positions the positioning-and-orienting arm 23 a lateral distance from the mounting clamp 39, creating space for the user to place his or her jaw when utilizing the present invention. The preferred offsetting bracket 38 is an L-shaped bracket with one leg being attached to the tubular spacer 32 and the other leg being rotatably connected to the mounting clamp 39, thus providing an additional degree of freedom for the positioning-and-orienting arm 23.

It is important to note that the various connections in between the constituents of the positioning-and-orienting arm 23 are lockable to prevent accidental movement during aiming and shooting of the bow and arrow. The lockable connections may be accomplished through a variety of means including, but not limited to, nut-and-bolt fasteners, screw-and-slot locking fasteners, pin-slot mechanisms, and other similar mechanisms. For example, the lockable hinge joint 24 is attached to the annular plate 2 through a nut-and-bolt fastener which, if released, allows the two components to rotate relative to each other about the main axis of the bolt. Additionally, in one embodiment, the telescoping link 25 is connected to the lockable hinge joint 24 through the use of a screw and a locking washer. Yet another example is seen in FIG. 6, where the telescoping link 25, the tubular spacer 32, and the offsetting bracket 38 are all connected together through an elongated bolt and a complimentary nut. Any alternative mechanisms may also be used to achieve the aforementioned connections.

The telescoping link 25 extends and contracts in order to increase or decrease the overall length of the positioning-and-orienting arm 23. In one embodiment, the telescoping link 25 comprises a proximal mount 26, a coupling sleeve 27, a shaft 30, and a distal mount 31. The proximal mount 26 couples the positioning-and-orienting arm 23 to the lockable hinge joint 24. More specifically, the proximal mount 26 is rotatably connected to the lockable hinge joint 24 about a first rotational axis 33. The shaft 30 and the coupling sleeve 27 make up the extendable body of the telescoping link 25. The shaft 30 is rotatably connected to the proximal mount 26 about a second rotational axis, wherein the first rotational axis 33 and the second rotational axis 34 are perpendicularly oriented to each other as seen in FIG. 6. The shaft 30 may come in a variety of lengths to further allow the user to vary the possible lengths of the telescoping link 25. The coupling sleeve 27 is positioned adjacent to the shaft 30, opposite the proximal, with the shaft 30 being slidably engaged into the coupling sleeve 27. More specifically, the coupling sleeve 27 comprises a first locking collar 28 and a second locking collar 29 which act as fastening mechanisms in order to lock the telescoping link 25 into a specific length configuration. The first locking collar 28 and the second locking collar 29 are positioned opposite to each other along the coupling sleeve 27. The first locking collar 28 and the second collar each contain a pair of screws with a pair of complimentary threaded holes. The distal mount 31 connects the telescoping link 25 to the tubular spacer 32. The distal mount 31 is rotatably connected to the coupling sleeve 27 about the second rotational axis 34, opposite the shaft 30, and the tubular spacer 32 is rotatably connected to the distal mount 31 about a third axis: wherein the third rotational axis 35 and the second rotational axis 34 are perpendicularly oriented to each other. The rotatably connected between the distal mount 31 and the coupling sleeve 27 provide an additional degree of freedom for the positioning-and-orienting arm 23. In an alternative embodiment, the present invention may utilize more than one telescoping link 25 for additional customization options and additional degrees of freedom.

Figure 3:
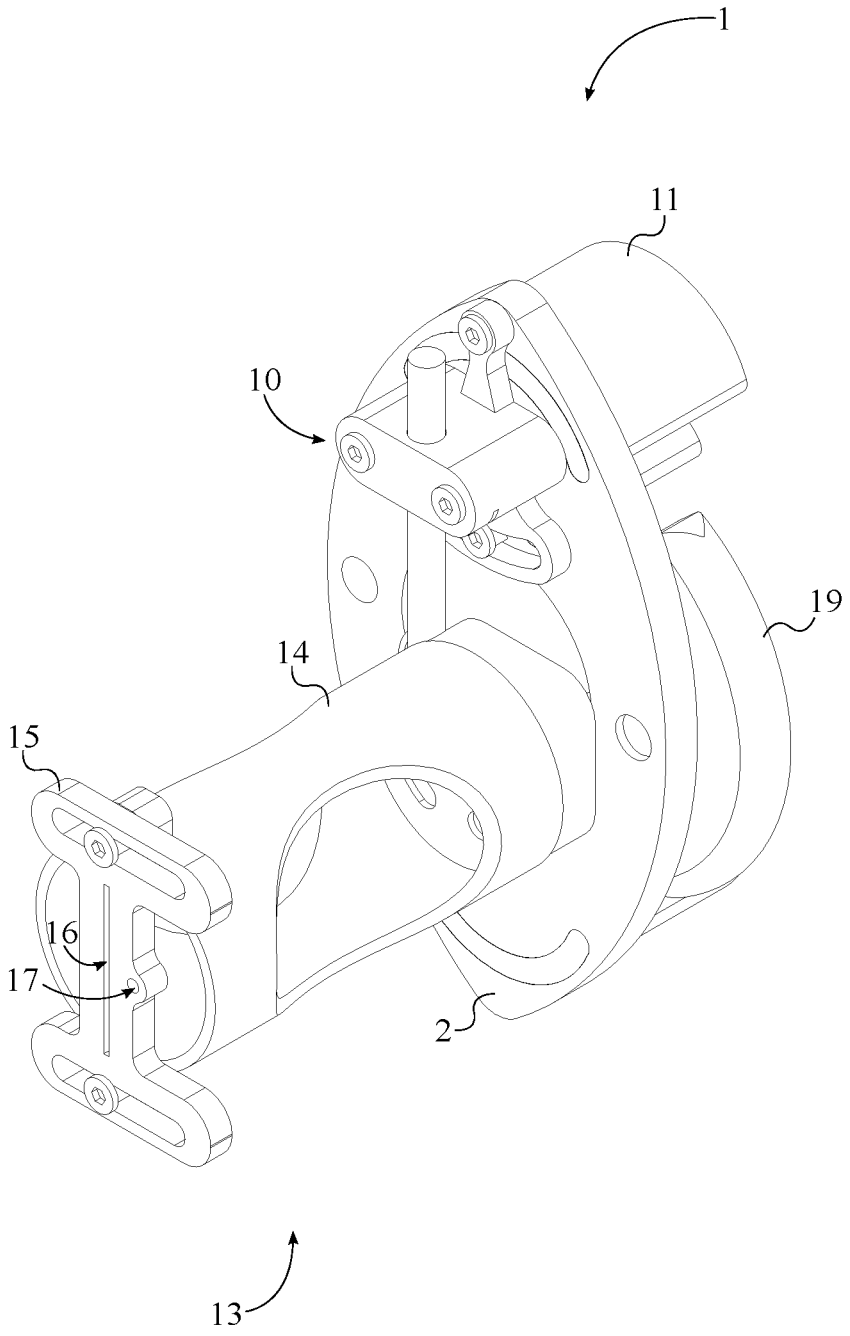
FIG. 3 is a perspective view of the sighting assembly components of the present invention with the adjustable sighting gauge included.

In one embodiment of the present invention, the sighting assembly 1 further comprises an adjustable sighting gauge 13. The adjustable sighting gauge 13 provides additional apertures that may be used to improve the accuracy of the shot. The adjustable sighting gauge 13 comprises a tubular adaptor 14, a sight plate 15, and a sighting slot 16. The tubular adaptor 14 is used as a spacer in order to offset the sight plate 15 from the first peephole 8. The tubular adaptor 14 is positioned adjacent to the sight eyepiece 7, opposite the annular plate 2, and is aligned parallel with the first peephole 8 of the sight eyepiece 7. This aligns the sighting slot 16 along the same path as the first peephole 8. In order to allow the user to rotate the sight plate 15, and therefore the sighting slot 16, the tubular adaptor 14 is rotatably connected to the sight eyepiece 7. The preferred embodiment also includes two semi-circular cut outs that traverse laterally through the tubular adaptor 14. These cut outs illuminate the interior of the tubular adaptor 14, increasing visibility. The sight plate 15 is adjacently and slidably attached to the tubular adaptor 14, opposite the sight eyepiece 7. This is achieved preferably through a pair of tracks. The pair of tracks traverses through the sight plate 15, positioned on either end of the sight plate 15 as seen in FIG. 3. A pair of screws are used to fasten the sight plate 15 to the tubular adaptor 14 by traversing through the pair of tracks and engaging the tubular adaptor 14. Rotating the pair of screws will release or fasten the sight plate 15 relative to the tubular adaptor 14, allowing the user to slide the sight plate 15 along the pair of tracks and thus position the sighting slot 16 according to his or her preference. The sighting slot 16 is oriented parallel to the first peephole 8 of the sight eyepiece 7 and traverses through the sight plate 15. The sighting slot 16 provides the user with an additional visual reference that he or she may use for aiming purposes. Using duel sights provides the user with a more accurate straight line of sight from eye to impact.

In another embodiment of the present invention, the adjustable sighting gauge 13 further comprises a second peephole 17. The second peephole 17 provides an alternative way to implement a dual sight version of the present invention. Similar to the sighting slot 16, the second peephole 17 is oriented parallel to the first peephole 8 of the sight eyepiece 7 and traverses through the sight plate 15, adjacent to the sighting slot 16. The second peephole 17 provides an additional aperture that the user may utilize as a visual reference for aiming purposes. Using duel sights provides the user with a more accurate straight line of sight from eye to impact. A diameter of the first peephole 8 is preferably greater than a diameter of the second peephole 17 although different sizing may be used in alternative embodiments of the present invention.

Figure 7:
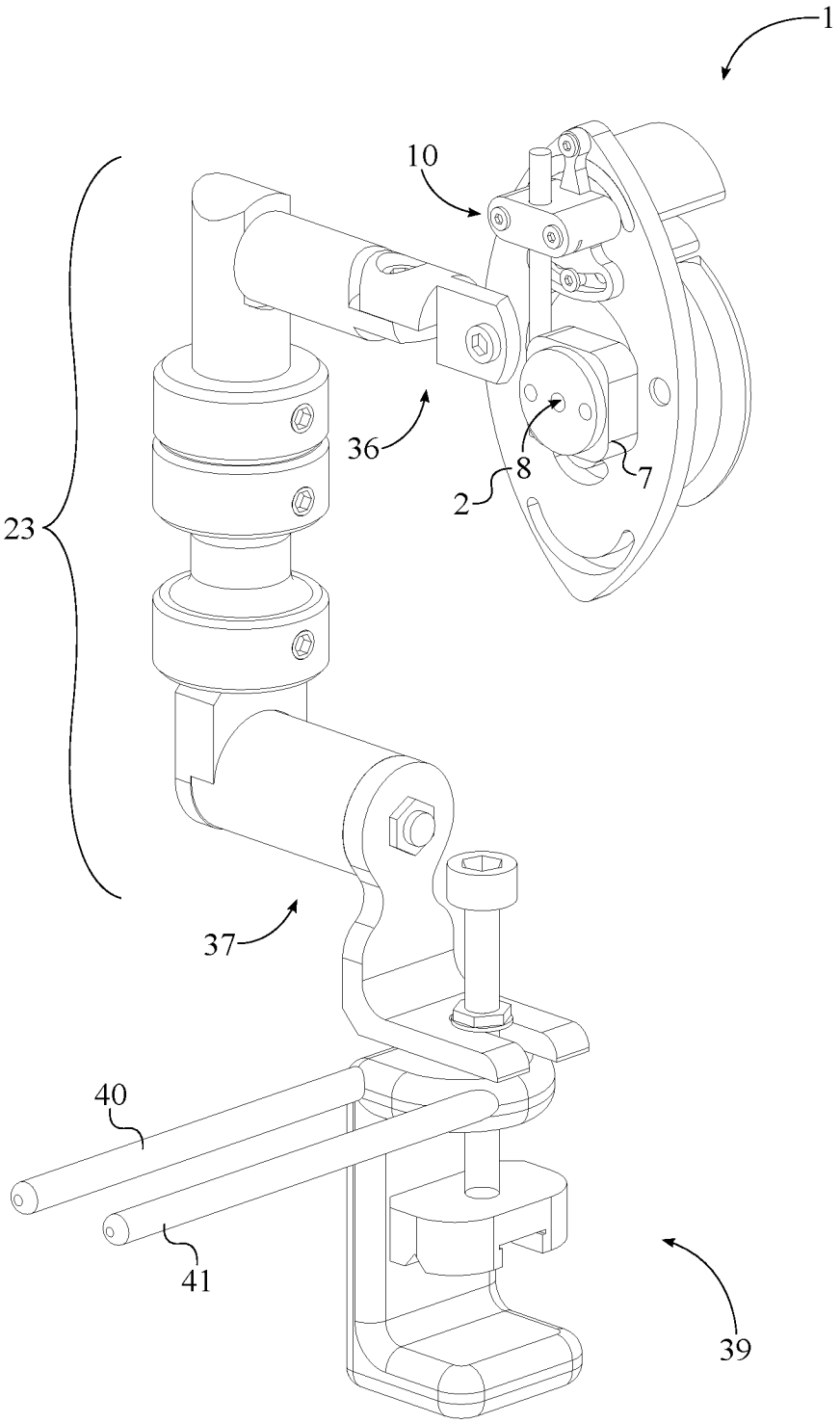
FIG. 7 is a perspective view of an alternative embodiment of the present invention depicting the first string rod and the second string rod.

Referring to FIG. 7, in one embodiment of the present invention, a first string rod 40 and a second string rod 41 may also be used in order to guide the user in aligning the first peephole 8 of the sight eyepiece 7 with the line of sight of the arrow. The first string rod 40 and the second string rod 41 are oriented parallel to a central axis 6 of the annular plate 2 and positioned offset to each other. The first string rod 40 is adjacently attached to the mounting clamp 39. Similarly, the second string rod 41 is adjacently attached to the mounting clamp 39, across the mounting clamp 39. This configuration forms a slot in between the first string rod 40 and the second string rod 41 which receives one end of the arrow and the bowstring. The length and diameter of the first string rod 40 and the second string rod 41 may vary to accommodate specific needs of the user.

In alternative embodiments of the present invention, the sight eyepiece 7 may be replaced with crosshairs and or adjustable sight pin(s) of varying colors. Another alternative embodiment may integrate a laser, a spot light, optical scopes, or alternative scope designs into the sighting assembly 1. Furthermore, the sighting assembly 1 may also include an integrated range finder, small awning on the annular plate 2 to shield light, prescription lenses integrated into the central hole 3 or the annular plate 2, tinted or colored lenses or glass, infrared capabilities, mechanisms for connecting to glasses, or any combination thereof.

Alternate embodiments of the present invention may include a variety of attachments to accommodate different style releases. Such attachments include mechanisms and features for the hand or wrist of the user, thus attaching the present invention directly to the user's hand. Another embodiment may include a placement arm which presses against the nose, chin, corner of the mouth, or anywhere for a desired consistent anchor. Another embodiment may include an arm that hooks behind the ear. Another embodiment may include a light source integrated into the sighting assembly 1 that shines light on the sight pins or sight eyepiece 7. Another embodiment may include a release that is integrated into the apparatus. This embodiment does not require the mounting clamp 39 as the positioning-and-orienting arm 23 is permanently affixed to the release mechanism. This embodiment allows a user to more easily engage the apparatus to a bow and maintain the same advantages of the preferred embodiment such as no additional weight added to the bow, increased speed of the bow, and decreased noise of the bow. This embodiment may include a variety of release devices and is not limited to any one type of release device. Another embodiment may include a means for adjusting the size and position of the central hole 3. In another embodiment, the first eye support 11 and the second eye support 12 in conjunction with the nose support 19 utilize a design similar to eyeglasses. In another embodiment, a camera may be integrated into the sighting assembly 1 in order to provide the present invention with video capabilities. In another embodiment, the present invention may provide the user with reticle eye movement in relation to the target. In another embodiment, the present invention may utilize an extended positioning-and-orienting arm 23 which caters to right hand shooters that are left eye dominant and left hand shooters that are right eye dominant. In another embodiment, the present invention may utilize various mechanisms to provide the user with quick release options and as well as quick adjustment features. In another embodiment, the present invention may contain cushion regions for increased comfort for the user.

Although the invention has been explained in relation to its preferred embodiment, it is to be understood that many other possible modifications and variations can be made without departing from the spirit and scope of the invention as hereinafter claimed.

What is claimed is:

1. An archery sighting device for a mechanical release comprises:
- a sighting assembly;
- a positioning-and-orienting arm with multiple degrees of freedom;
- a mounting clamp;
- the sighting assembly comprises an annular plate, a sight eyepiece, and a telescoping support arm;
- the sight eyepiece being oriented normal to the annular plate;
- a lateral boundary being defined as an extension of an inner wall of the annular plate;
- a first peephole of the sight eyepiece being positioned parallel and within the lateral boundary;
- the telescoping support arm being swivelably and adjacently connected to the annular plate;
- the sight eyepiece being adjacently connected to the telescoping support arm, opposite the annular plate;
- a first end of the positioning-and-orienting arm being adjacently attached to the annular plate; and
- a second end of the positioning-and-orienting arm being adjacently attached to the mounting clamp.

2. The archery sighting device for a mechanical release as claimed in claim 1 comprises:
- the sighting assembly further comprises a first eye support and a second eye support;
- the first eye support being connected adjacent to the annular plate, opposite the sight eyepiece;
- the second eye support being connected adjacent to the annular plate, opposite the sight eyepiece; and
- the first eye support and the second eye support being positioned opposite to each other across a central hole of the annular plate.

3. The archery sighting device for a mechanical release as claimed in claim 1 comprises:
- the sighting assembly further comprises an adjustable sighting gauge;
- the adjustable sighting gauge comprises a tubular adaptor, a sight plate, and a sighting slot;
- the tubular adaptor being positioned adjacent to the sight eyepiece, opposite the annular plate;
- the tubular adaptor being aligned parallel with the first peephole of the sight eyepiece;
- the tubular adaptor being rotatably connected to the sight eyepiece;
- the sight plate being positioned adjacent to the tubular adaptor, opposite the sight eyepiece;
- the sight plate being slidably attached across the tubular adaptor;
- the sighting slot being oriented parallel to the first peephole of the sight eyepiece; and
- the sighting slot traversing through the sight plate.

4. The archery sighting device for a mechanical release as claimed in claim 3 comprises:
- the adjustable sighting gauge further comprises a second peephole;
- the second peephole being oriented parallel to the first peephole of the sight eyepiece; and
- the second peephole traversing through the sight plate, adjacent to the sighting slot.

5. The archery sighting device for a mechanical release as claimed in claim 1 comprises:
- the sighting assembly further comprises a nose support and a stud;
- the nose support comprises a semi-elliptical concave surface and an arc-shaped track;
- the arc-shaped track traversing through the nose support, parallel to the semi-elliptical concave surface;
- the stud and the first end of the positioning-and-orienting arm being positioned opposite to each other about the central hole of the annular plate;
- the stud being connected normal to the annular plate; and
- the nose support being slidably and rotatably connected to the annular plate by engaging the stud into the arc-shaped track.

6. The archery sighting device for a mechanical release as claimed in claim 1 comprises:
- a first string rod;
- a second string rod;
- the first string rod and the second string rod being oriented parallel to a central axis of the annular plate;
- the first string rod and the second string rod being positioned offset to each other;
- the first string rod being adjacently attached to the mounting clamp; and
- the second string rod being adjacently attached to the mounting clamp.

7. The archery sighting device for a mechanical release as claimed in claim 1 comprises:
- an offsetting bracket;
- the positioning-and-orienting arm comprises a lockable hinge joint, a telescoping link, and a tubular spacer;
- the lockable hinge joint being rotatably and adjacently attached to the annular plate;
- the telescoping link being adjacently positioned to the lockable hinge joint, opposite the annular plate;
- the telescoping link being rotatably connected to the lockable hinge joint;
- the tubular spacer being perpendicularly oriented to the telescoping link;
- the tubular spacer being adjacently positioned to the telescoping link, opposite the lockable hinge joint;
- the tubular spacer being rotatably connected to the telescoping link; and
- the mounting clamp being adjacently connected to the tubular spacer by the offsetting bracket, opposite the telescoping link.

8. The archery sighting device for a mechanical release as claimed in claim 7 comprises:
- the telescoping link comprises a proximal mount, a coupling sleeve, a shaft, and a distal mount;

the proximal mount being rotatably connected to the lockable hinge joint about a first rotational axis;

the shaft being rotatably connected to the proximal mount about a second rotational axis;

the first rotational axis and the second rotational axis being perpendicularly oriented to each other;

the coupling sleeve being positioned adjacent to the shaft, opposite the proximal mount;

the shaft being slidably engaged into the coupling sleeve;

the distal mount being rotatably connected to the coupling sleeve about the second rotational axis, opposite the shaft;

the tubular spacer being rotatably connected to the distal mount about a third rotational axis; and the second rotational axis and the third rotational axis being perpendicularly oriented to each other.

9. The archery sighting device for a mechanical release as claimed in claim 8 comprises:

the coupling sleeve comprises a first locking collar and a second locking collar; and the first locking collar and the second locking collar being positioned opposite to each other along the coupling sleeve.

10. An archery sighting device for a mechanical release comprises:

a sighting assembly;

a positioning-and-orienting arm with multiple degrees of freedom;

a mounting clamp;

the sighting assembly comprises an annular plate, a sight eyepiece, a telescoping support arm, and a sighting gauge;

the sight eyepiece being oriented normal to the annular plate;

a lateral boundary being defined as an extension of an inner wall of the annular plate;

a first peephole of the sight eyepiece being positioned parallel and within the lateral boundary;

the adjustable sighting gauge comprises a tubular adaptor, a sight plate, and a sighting slot;

the tubular adaptor being positioned adjacent to the sight eyepiece, opposite the annular plate;

the tubular adaptor being aligned parallel with the first peephole of the sight eyepiece;

the tubular adaptor being rotatably connected to the sight eyepiece;

the sight plate being positioned adjacent to the tubular adaptor, opposite the sight eyepiece;

the sight plate being slidably attached across the tubular adaptor;

the sighting slot being oriented parallel to the first peephole of the sight eyepiece;

the sighting slot traversing through the sight plate;

the telescoping support arm being swivelably and adjacently connected to the annular plate;

the sight eyepiece being adjacently connected to the telescoping support arm, opposite the annular plate;

a first end of the positioning-and-orienting arm being adjacently attached to the annular plate; and a second end of the positioning-and-orienting arm being adjacently attached to the mounting clamp.

11. The archery sighting device for a mechanical release as claimed in claim 10 comprises:

the sighting assembly further comprises a first eye support and a second eye support;

the first eye support being connected adjacent to the annular plate, opposite the sight eyepiece;

the second eye support being connected adjacent to the annular plate, opposite the sight eyepiece; and the first eye support and the second eye support being positioned opposite to each other across a central hole of the annular plate.

12. The archery sighting device for a mechanical release as claimed in claim 10 comprises:

the adjustable sighting gauge further comprises a second peephole;

the second peephole being oriented parallel to the first peephole of the sight eyepiece; and the second peephole traversing through the sight plate, adjacent to the sighting slot.

13. The archery sighting device for a mechanical release as claimed in claim 10 comprises:

the sighting assembly further comprises a nose support and a stud;

the nose support comprises a semi-elliptical concave surface and an arc-shaped track;

the arc-shaped track traversing through the nose support, parallel to the semi-elliptical concave surface;

the stud and the first end of the positioning-and-orienting arm being positioned opposite to each other about the central hole of the annular plate;

the stud being connected normal to the annular plate; and the nose support being slidably and rotatably connected to the annular plate by engaging the stud into the arc-shaped track.

14. The archery sighting device for a mechanical release as claimed in claim 10 comprises:

a first string rod;

a second string rod;

the first string rod and the second string rod being oriented parallel to a central axis of the annular plate;

the first string rod and the second string rod being positioned offset to each other;

the first string rod being adjacently attached to the mounting clamp; and the second string rod being adjacently attached to the mounting clamp.

15. The archery sighting device for a mechanical release as claimed in claim 10 comprises:

an offsetting bracket;

the positioning-and-orienting arm comprises a lockable hinge joint, a telescoping link, and a tubular spacer;

the lockable hinge joint being rotatably and adjacently attached to the annular plate;

the telescoping link being adjacently positioned to the lockable hinge joint, opposite the annular plate;

the telescoping link being rotatably connected to the lockable hinge joint;

the tubular spacer being perpendicularly oriented to the telescoping link;

the tubular spacer being adjacently positioned to the telescoping link, opposite the lockable hinge joint;

the tubular spacer being rotatably connected to the telescoping link; and the mounting clamp being adjacently connected to the tubular spacer by the offsetting bracket, opposite the telescoping link.

16. The archery sighting device for a mechanical release as claimed in claim 15 comprises:

the telescoping link comprises a proximal mount, a coupling sleeve, a shaft, and a distal mount;

the proximal mount being rotatably connected to the lockable hinge joint about a first rotational axis;

the shaft being rotatably connected to the proximal mount about a second rotational axis;

the first rotational axis and the second rotational axis being perpendicularly oriented to each other;

the coupling sleeve being positioned adjacent to the shaft, opposite the proximal mount;

the shaft being slidably engaged into the coupling sleeve;

the distal mount being rotatably connected to the coupling sleeve about the second rotational axis, opposite the shaft;

the tubular spacer being rotatably connected to the distal mount about a third rotational axis; and the second rotational axis and the third rotational axis being perpendicularly oriented to each other.

17. The archery sighting device for a mechanical release as claimed in claim 16 comprises:

the coupling sleeve comprises a first locking collar and a second locking collar; and the first locking collar and the second locking collar being positioned opposite to each other along the coupling sleeve.

* * * * *